US006241036B1

(12) United States Patent
Lovato et al.

(10) Patent No.: US 6,241,036 B1
(45) Date of Patent: Jun. 5, 2001

(54) REINFORCED ABRASIVE-IMPREGNATED CUTTING ELEMENTS, DRILL BITS INCLUDING SAME

(75) Inventors: Lorenzo G. Lovato; Gordon A. Tibbitts, both of Salt Lake City, UT (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/154,383

(22) Filed: Sep. 16, 1998

(51) Int. Cl.[7] ..... E21B 10/36

(52) U.S. Cl. ..... 175/432; 175/434; 175/426; 175/428

(58) Field of Search ..... 175/432, 434, 175/428, 426

(56) References Cited

U.S. PATENT DOCUMENTS

| | | | | |
|---|---|---|---|---|
| Re. 32,380 | | 3/1987 | Wentorf, Jr. et al. . | |
| 2,326,908 | | 5/1942 | Williams, Jr. | 175/405.1 |
| 2,371,489 | | 3/1945 | Williams, Jr. | 255/61 |
| 2,582,231 | | 1/1952 | Catallo . | |
| 3,106,973 | | 10/1963 | Christensen | 175/113 |
| 3,537,538 | | 11/1970 | Generoux . | |
| 3,709,308 | * | 1/1973 | Rowley et al. | 175/434 |
| 3,800,891 | | 4/1974 | White et al. . | |
| 3,841,852 | | 10/1974 | Wilder et al. | 51/295 |
| 3,871,840 | | 3/1975 | Wilder et al. | 51/295 |
| 3,885,637 | | 5/1975 | Veprintsev et al. | 175/329 |
| 3,938,599 | | 2/1976 | Horn | 175/329 |
| 4,098,362 | | 7/1978 | Bonnice | 175/329 |
| 4,128,136 | | 12/1978 | Generoux . | |
| 4,176,723 | * | 12/1979 | Arceneaux | 175/434 |
| 4,234,048 | | 11/1980 | Rowley . | |
| 4,255,165 | | 3/1981 | Dennis et al. | 51/309 |
| 4,274,769 | | 6/1981 | Multakh | 408/145 |
| 4,274,840 | | 6/1981 | Housman . | |
| 4,333,540 | | 6/1982 | Daniels et al. . | |
| 4,465,148 | * | 8/1984 | Morris et al. | 175/428 |
| 4,525,178 | | 6/1985 | Hall | 51/309 |
| 4,570,725 | * | 2/1986 | Matthias et al. | 175/432 |
| 4,592,433 | | 6/1986 | Dennis | 175/329 |

(List continued on next page.)

FOREIGN PATENT DOCUMENTS

| | | |
|---|---|---|
| 3347501 A1 | 9/1985 | (DE) . |
| 0 029 535 A1 | 11/1980 | (EP) . |
| 0 284 579 A1 | 3/1988 | (EP) . |
| 0 356 097 A2 | 8/1989 | (EP) . |
| 0 356 097 A3 | 8/1989 | (EP) . |
| 0 601 840 A1 | 12/1993 | (EP) . |
| 632-823 | 11/1978 | (SU) . |

OTHER PUBLICATIONS

PCT International Search Report of Feb. 21, 2000.

*Primary Examiner*—Brian L. Johnson
*Assistant Examiner*—Joselynn Z. Sliteris
(74) *Attorney, Agent, or Firm*—TraskBritt

(57) ABSTRACT

A cutting element for use on a rotary-type earth boring drill bit for drilling subterranean formations including a segment and a support member. The support member is preferably fabricated from a tough and ductile material, such as iron, an iron-based alloy, nickel, a nickel-based alloy, copper, a copper-based alloy, titanium, a titanium-based alloy, zirconium, a zirconium-based alloy, silver, or a silver-based alloy. A bit attachment portion of the support member is securable to a bit body. A segment-receiving portion of the support member is disposable within a recess formed in the segment to secure the segment to the bit body and support the segment during use of the drill bit. Preferably, the segment is fabricated from a hard continuous phase material that is impregnated with a particulate abrasive material, such as natural diamond, synthetic diamond, or cubic boron nitride. The continuous phase material and abrasive material may be aggregated by sintering, hot isostatic pressing, laser melting, or ion beam melting.

34 Claims, 13 Drawing Sheets

U.S. PATENT DOCUMENTS

| | | | | |
|---|---|---|---|---|
| 4,604,106 | | 8/1986 | Hall et al. . | |
| 4,629,373 | * | 12/1986 | Hall | 175/434 |
| 4,670,025 | | 6/1987 | Pipkin . | |
| 4,686,080 | | 8/1987 | Hara et al. . | |
| 4,719,979 | | 1/1988 | Jones | 175/329 |
| 4,726,718 | * | 2/1988 | Meskin et al. | 175/434 |
| 4,844,185 | | 7/1989 | Newton, Jr. et al. | 175/431 |
| 4,861,350 | | 8/1989 | Phaal et al. . | |
| 4,889,017 | | 12/1989 | Fuller et al. | 76/108 |
| 4,898,252 | | 2/1990 | Barr . | |
| 4,902,652 | | 2/1990 | Kume et al. . | |
| 4,940,180 | | 7/1990 | Martell . | |
| 4,943,488 | | 7/1990 | Sung et al. . | |
| 4,990,403 | | 2/1991 | Ito . | |
| 4,991,670 | | 2/1991 | Fuller et al. | 175/329 |
| 5,025,871 | | 6/1991 | Stewart et al. | 175/57 |
| 5,049,164 | | 9/1991 | Horton et al. . | |
| 5,099,935 | | 3/1992 | Anthon et al. . | |
| 5,103,922 | | 4/1992 | Jones | 175/429 |
| 5,147,001 | | 9/1992 | Chow et al. | 175/428 |
| 5,158,148 | * | 10/1992 | Keshavan | 175/434 |
| 5,279,375 | | 1/1994 | Tibbitts et al. . | |
| 5,282,513 | | 2/1994 | Jones | 175/434 |
| 5,413,772 | | 5/1995 | Pinneo | 423/446 |
| 5,505,272 | | 4/1996 | Clark | 175/405.1 |
| 5,560,440 | | 10/1996 | Tibbitts | 175/384 |
| 5,564,511 | * | 10/1996 | Frushour | 175/434 |
| 5,566,779 | | 10/1996 | Dennis . | |
| 5,590,729 | * | 1/1997 | Cooley et al. | 175/432 |
| 5,592,995 | * | 1/1997 | Scott et al. | 175/434 |
| 5,732,783 | | 3/1998 | Truax et al. | 175/374 |
| 5,743,346 | | 4/1998 | Flood et al. . | |
| 5,788,001 | | 8/1998 | Matthias et al. | 175/432 |
| 5,829,541 | * | 11/1998 | Flood et al. | 175/432 |
| 5,836,409 | | 11/1998 | Vail, III | 175/379 |
| 5,928,071 | * | 7/1999 | Devlin | 175/432 |
| 5,979,578 | | 11/1999 | Packer | 175/432 |
| 6,009,962 | * | 1/2000 | Beaton | 175/426 |

* cited by examiner

REINFORCED ABRASIVE-IMPREGNATED CUTTING ELEMENTS, DRILL BITS INCLUDING SAME

BACKGROUND OF THE INVENTION

1. Field of the Invention

The present invention relates to cutting elements for use on earth boring drill bits and bits so equipped. In particular, the present invention relates to a cutting element which includes a support which interconnects an abrasive-impregnated cutting structure to the drill bit and mechanically reinforces the impregnated segment. More specifically, the cutting element of the present invention includes a tough and ductile support structure which may be internal or external to the impregnated segment.

2. Background of Related Art

Conventionally, earth boring drill bits with impregnated cutting structures, commonly termed "segments," have been employed to bore through very hard and abrasive formations, such as basalt, dolomite and hard sandstone. As depicted by FIG. 1, the impregnated segments 16 of such drill bits are typically secured to the boring end 14, which is typically termed the "face," of the bit body 12 of the drill bit 10 in a generally radial fashion. Impregnated segments may also be disposed concentrically over the face of the drill bit. As the drill bit gradually grinds through a very hard and abrasive formation, the outermost layer of the impregnated segments containing abrasive particles (such as small diamonds, diamond grit, or other superabrasive particles such as cubic boron nitride) wear and may fracture. Many conventional impregnated segments are designed to release, or "shed", such diamonds or grit in a controlled manner during use of the drill bit. As a layer of diamonds or grit is shed from the face, underlying diamonds are exposed as abrasive cuttings and the diamonds that have been shed from the drill bit wear away the exposed continuous phase of the segment in which the interior diamonds are dispersed, thereby "resharpening" the bit until the entire diamond-impregnated portion of the bit has been consumed. Thus, drill bits with diamond-impregnated segments typically maintain a substantially constant boring rate as long as diamonds remain exposed on such segments.

Conventional impregnated segments typically carry the super-abrasive particles in a continuous phase of a hard material, such as tungsten carbide, a tungsten alloy, a metal carbide, a refractory metal alloy, a ceramic, copper, a copper-based alloy, nickel, a nickel-based alloy, cobalt, a cobalt-based alloy, iron, an iron-based alloy, silver, or a silver-based alloy. Such materials are, however, typically relatively brittle and may fracture when subjected to the stresses of drilling. Accordingly, when subjected to the high stresses of drilling, and particularly impact stresses, the continuous phase of such impregnated segments may break, resulting in the premature failure thereof and potentially the premature failure of the bit upon which such segments are carried. Thus, drilling times and costs are increased by premature failure of conventional impregnated segments, as it is necessary to remove the drill string from the bore hole, replace the entire drill bit, and reintroduce the drill string into the bore hole.

U.S. Pat. No. 4,234,048 (the "'048 patent"), which issued to David S. Rowley on Nov. 18, 1980, discloses an exemplary drill bit that bears diamond-impregnated segments on the crown thereof. Typically, the impregnated segments of such drill bits are C-shaped or hemispherically shaped, somewhat flat, and arranged somewhat radially around the crown of the drill bit. Each impregnated segment typically extends from the inner cone of the drill bit, over the rose and up the bit face to the gage. The impregnated segments may be attached directly to the drill bit during fabrication, or partially disposed within a slot or channel formed into the crown and secured to the drill bit by brazing. When attached to the crown of a drill bit, conventional impregnated segments have a relatively low profile (i.e., shallow recesses between adjacent segments) relative to the bit face and a footprint that covers the majority of the drill bit surface from the nose to the gage. The low profile is typically required due to the relatively brittle materials from which the continuous phases of conventional impregnated segments are formed. Similarly, the generally semicircular shape of conventional impregnated segments and their somewhat radial arrangement around the crown of a bit body are required to prevent the breakage and premature wear of such impregnated segments due to the hard but relatively brittle continuous phase materials thereof. The large "footprint" of conventional impregnated segment-bearing drill bits is typically necessary to provide a sufficient amount of cutting material on the face of the bit. To some extent, the conventionally required semicircular shape of impregnated segments has also prohibited the use of alternative impregnated segment shapes, drill bit designs, and arrangements of impregnated segments on drill bits, which could otherwise optimize drilling rates and reduce the rate of bit wear and failure.

Because of the low profile or exposure and large surface area footprint of conventional impregnated segments, very little clearance exists between the face of the drill bit and the drilled formation during use of the drill bit upon which such segments are carried. Consequently, the build-up of formation fines, such as rock flour, on the impregnated segments may prevent contact of the impregnated segments with the interior surface of the bore hole, and may reduce the depth of cut of the drill bit. Moreover, due to the large surface area footprint and the low profile of impregnated segments on conventional drill bits, the hydraulics of such drill bits cannot be employed to remove formation fines therefrom or to cool the segments. Therefore, the rate of drilling and the amount of weight on bit that may be employed on the drill bit may be decreased, while the rate of wear is undesirably high, and failure of the drill bit may occur.

Thus, there is a need for an impregnated segment which will better resist breakage during drilling of very hard and abrasive formations, and which may be optimally designed and arranged upon a drill bit. There is also a need for impregnated segments which may be arranged on a drill bit to facilitate the use of drill bit hydraulics to remove formation fines from the impregnated surfaces of the drill bit and which facilitate the use of alternative drill bit designs.

SUMMARY OF THE INVENTION

The cutting elements of the present invention address the foregoing needs.

The cutting elements of the present invention include an impregnated cutting structure having an associated support member, which support member is securable to an earth boring rotary-type drill bit body, and provides mechanical support to the cutting structure.

The impregnated segment includes a continuous phase material impregnated with particles of an abrasive material. Preferably, the continuous phase material includes a hard, erosion- and wear-resistant material, such as metal carbide, a refractory metal alloy, a ceramic, copper, a copper-based alloy, nickel, a nickel-based alloy, cobalt, a cobalt-based alloy, iron, an iron-based alloy, silver, or a silver-based alloy. The abrasive material with which the continuous phase material is impregnated preferably comprises a hard, abrasive and abrasion-resistant material, and most preferably a super-abrasive material such as natural diamond, synthetic diamond, or cubic boron nitride. The impregnated segment may include more than one type of abrasive material, as well as one or more sizes of abrasive material particles. The impregnated segment is fabricated by mixing the continuous phase material with the abrasive material and employing known processes, such as hot isostatic pressing, sintering, laser melting, or ion beam melting, to fuse the mixture into a cutting structure of desired shape. The impregnated segment may be fabricated directly onto a segment-retaining portion, or segment-retaining surface, of the support member, or attached thereto by known techniques, such as brazing or mechanical affixation.

The support member of the inventive cutting element, which is preferably fabricated from a tough and ductile material, such as iron, an iron-based alloy, nickel, a nickel-based alloy, copper, a copper-based alloy, titanium, a titanium-based alloy, zirconium, a zirconium-based alloy, silver, or a silver-based alloy, and other tough and ductile materials that will withstand elevated temperatures, such as are experienced during sintering, brazing and bit furnacing, includes a segment-retaining portion and a drill bit attachment portion. The segment-retaining portion of the support member may be secured to the impregnated segment. The attachment portion of the support member is preferably insertable into a socket of a bit body and may be secured therein by brazing to the bit body, mechanical affixation, or other known processes. Alternatively, the support member may be secured to the bit body by integral infiltration therewith during fabrication thereof.

When attached to a drill bit, a portion of the impregnated segment may be recessed within the socket or a countersink thereabout and, therefore, protected by the bit face adjacent the peripheral edge of the socket that retains the cutting element. Such recessing of the impregnated segment may provide additional support to the impregnated segment and prevent dislodging of the impregnated segment from the support member by shielding the interface of the impregnated segment and the support member from drilling fluid and abrasive, erosive debris that may otherwise come into contact therewith during drilling.

Since the segment-retaining portion of the tough and ductile support member is preferably secured to the impregnated segment, the support member supports the impregnated segment during use of the drill bit. Accordingly, the impregnated segment may extend from the face of the drill bit body a greater distance than many conventional impregnated segments (i.e., the inventive impregnated segment may have an increased exposure relative to that of conventional impregnated segments). Thus, the segment-support member configuration of the cutting element of the present invention facilitates the use of alternatively shaped impregnated segments on a drill bit, alternative impregnated segment orientations on the drill bit, and differently shaped drill bits for boring through very hard and abrasive formations.

Other advantages of the present invention will become apparent to those of ordinary skill in the art through a consideration of the ensuing description, the drawings and the appended claims.

DETAILED DESCRIPTION OF THE PREFERRED EMBODIMENTS

Figure 2:
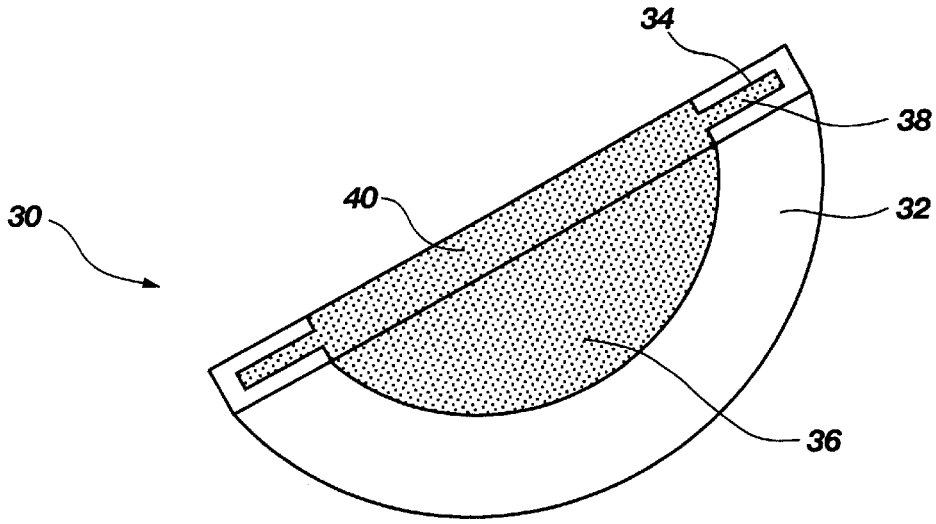
FIG. 2 is a perspective view of a first embodiment of a cutting element according to the present invention, including a C-shaped impregnated segment and a support member disposed in a concave portion of the impregnated segment.

With reference to FIG. 2, a first embodiment of a cutting element 30 according to the present invention is depicted. Cutting element 30 includes a substantially C-shaped impregnated segment 32 which defines a recess 34, which is also referred to as a member-securing portion or surface, in the concave portion thereof. Recess 34 is configured to receive a complementarily shaped segment-receiving portion 38 of a support member 36, which is also referred to as a member. A portion of support member 36 lying within the curve of the "C" of segment 32 is referred to as a bit attachment portion 40.

Impregnated segment 32 preferably includes a continuous phase, which may be a metallic phase, throughout which an abrasive, abrasion-resistant material is dispersed, as known in the art. Preferably, a continuous phase material is a hard, erosion-resistant and wear-resistant material. Continuous phase materials that are useful in impregnated segment 32 include, without limitation, metal carbides (e.g., tungsten carbide, titanium carbide, silicon carbide, etc.), refractory metal alloys, ceramics, copper, copper-based alloys, nickel, nickel-based alloys, cobalt, cobalt-based alloys, iron, iron-based alloys, silver, or silver-based alloys.

Abrasive materials that are useful in impregnated segment 32 and provide a cutting structure within the segment are preferably hard, abrasive and abrasion-resistant materials. Exemplary abrasive materials with which the continuous phase material of impregnated segment 32 may be impregnated include, but are not limited to, super-abrasives, such as natural diamonds, synthetic diamonds, cubic boron nitride, as well as other hard, abrasive and abrasion-resistant materials. The abrasive material may be coated with a single or multiple layers of metal coatings, as known in the art and disclosed in U.S. Pat. Nos. 4,943,488 and 5,049,164, the disclosures of each of which are hereby incorporated by reference in their entirety. Such metal coatings are known to increase the strength with which the abrasive material bonds to the continuous phase material. The abrasive material may be of a substantially uniform particle size, which may be measured in carats or mesh size, or may include particles of various sizes. Similarly, the continuous phase material may be impregnated with a combination of various types of abrasive materials. Impregnated segment 32 may also include secondary abrasives, such as ceramics and aluminum oxides.

The continuous phase material and abrasive material of impregnated segments 32 are preferably aggregated into a desired shape by known processes that bond the continuous phase material and the particles of abrasive material together, such as sintering, hot isostatic pressing, laser melting, or ion beam melting. Impregnated segment 32 may be fabricated with a recess or member-securing portion that is shaped to receive the segment-receiving portion 38 of support member 36 and subsequently secured thereto by known techniques, such as by the use of adhesives, brazing, or mechanical affixation. Alternatively, impregnated segment 32 may be formed directly onto support member 36 wherein impregnated segment 32 is simultaneously secured to support member 36.

Support member 36 is preferably fabricated from a tough and ductile material that will withstand the forces that are encountered by the drill bit while employed in the drilling of subterranean formations. Exemplary materials that may be used to fabricate support member 36 include, without limitation, iron, an iron-based alloy, nickel, a nickel-based alloy, copper, a copper-based alloy, titanium, a titanium-based alloy, zirconium, a zirconium-based alloy, silver, or a silver-based alloy, and other tough and ductile materials that will withstand elevated temperatures, such as are experienced during sintering, brazing and bit furnacing. Support member 36 may be manufactured by techniques known in the art, such as by sintering, casting, forging or machining.

Figure 2A:
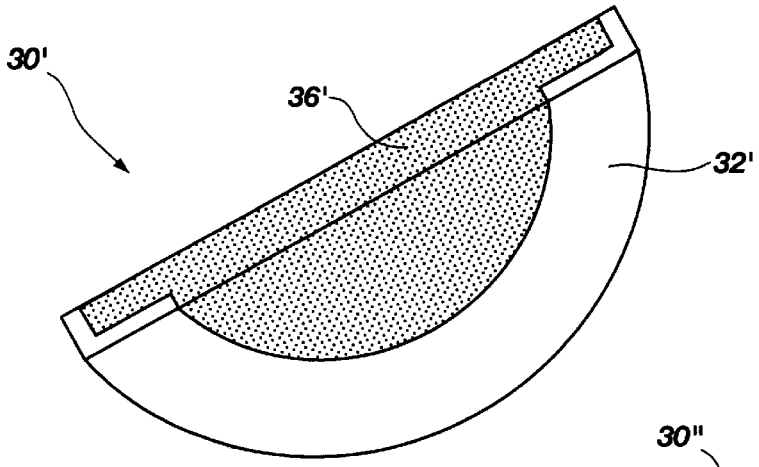
FIGS. 2*a*–2*c* are perspective views of variations of the cutting element of FIG. 2.
Figure 2B:
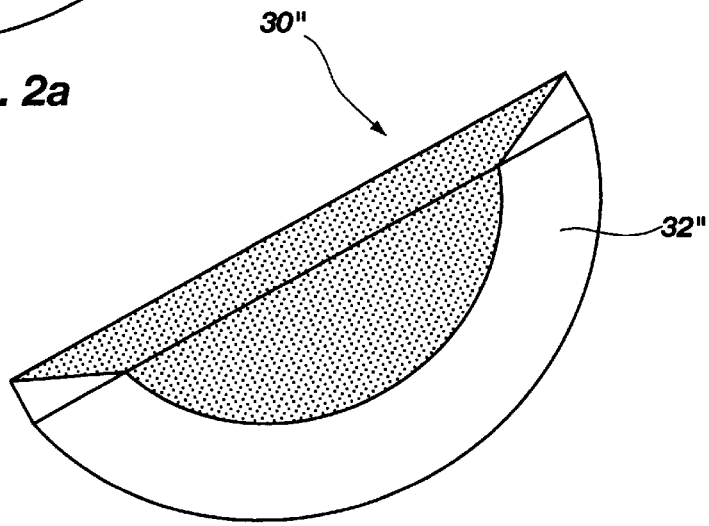
Figure 2C:
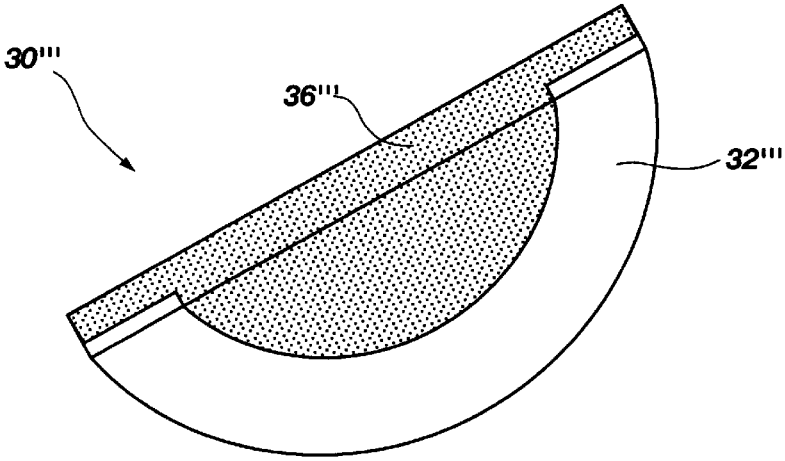

FIGS. 2*a*–2*c* illustrate exemplary variations of the cutting element 30 of FIG. 2 that are also within the scope of the present invention. FIG. 2*a* shows a cutting element 30' that includes an impregnated segment 32' having an L-shaped cross section. Preferably, when disposed on a drill bit, the portion of impregnated segment 32' that extends over the side of support member 36' faces in the same direction that the bit rotates. FIG. 2*b* shows a cutting element 30" including an impregnated segment 32" similar to that shown in FIG. 2*a*, but having a substantially triangular cross section. Again, the exposed side of impregnated segment 32" faces in the direction of bit rotation. FIG. 2*c* illustrates another variation, in which the cutting element 30'" includes an impregnated segment 32'" that is secured to a single major surface of the support member 36'".

Figure 3:
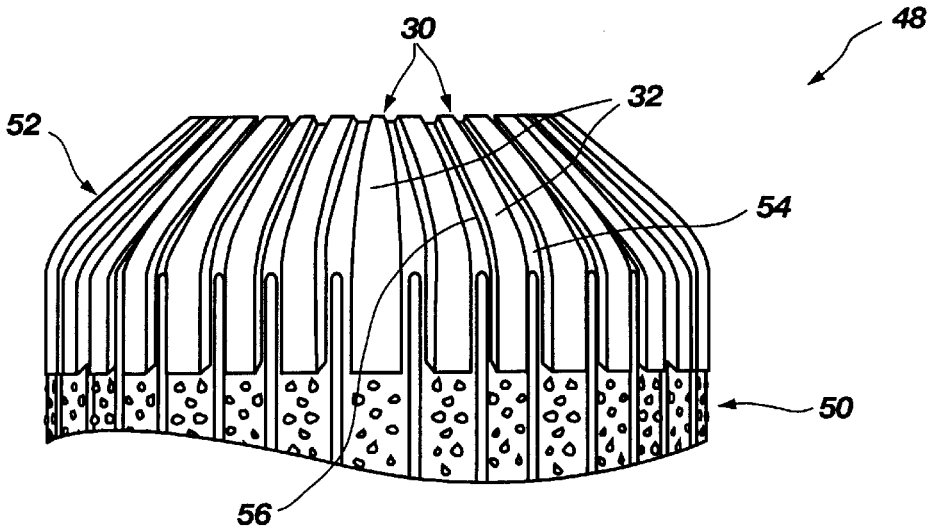
FIG. 3 is a partial inverted side plan view of a drill bit which includes the cutting elements of FIG. 2.

Referring to FIG. 3, a drill bit 48 is shown which includes several cutting elements 30 disposed in a generally radial fashion about the crown 52 of the bit 48. Preferably, the bit attachment portion 40 of the support member 36 (see FIG. 2) of each cutting element 30 is disposed within a slot 56 that is formed into crown 52 of drill bit 48 and shaped complementarily to bit attachment portion 40. Slots 56 may also be shaped to receive lower portions of impregnated segments 32, such that lower portions of impregnated segments 32 are recessed beneath and external to the bit face 54 so that the interfaces between segments 32 and support members 36 are protected from the drilling fluid and debris that are present in the bore hole during drilling.

The bit attachment portion 40 (see FIG. 2) of each cutting element 30 is secured to crown 52 by known techniques, such as by the use of adhesives, brazing, or mechanical affixation. Alternatively, and particularly when support member 36 is a particulate-based structure (e.g., a structure comprised of sintered steel), bit attachment portion 40 of each cutting element may be disposed within a mass of particulate-based matrix material used to form bit body 50, and the matrix material and support members integrally infiltrated, as known in the art. During infiltration, molten binder, typically a copper-based alloy, imbibes between the particles of the bit body 50 matrix and support member 36 by capillary action by, gravity, or under pressure. As the binder solidifies, it binds particles of the matrix to one another to form bit body 50 and fixes cutting elements 30 to bit body 50. As another alternative, a particulate-based support member 36 and its associated segment 32 may be infiltrated independently of the bit body, prior to assembly with or securing of same to crown 52.

Figure 1:
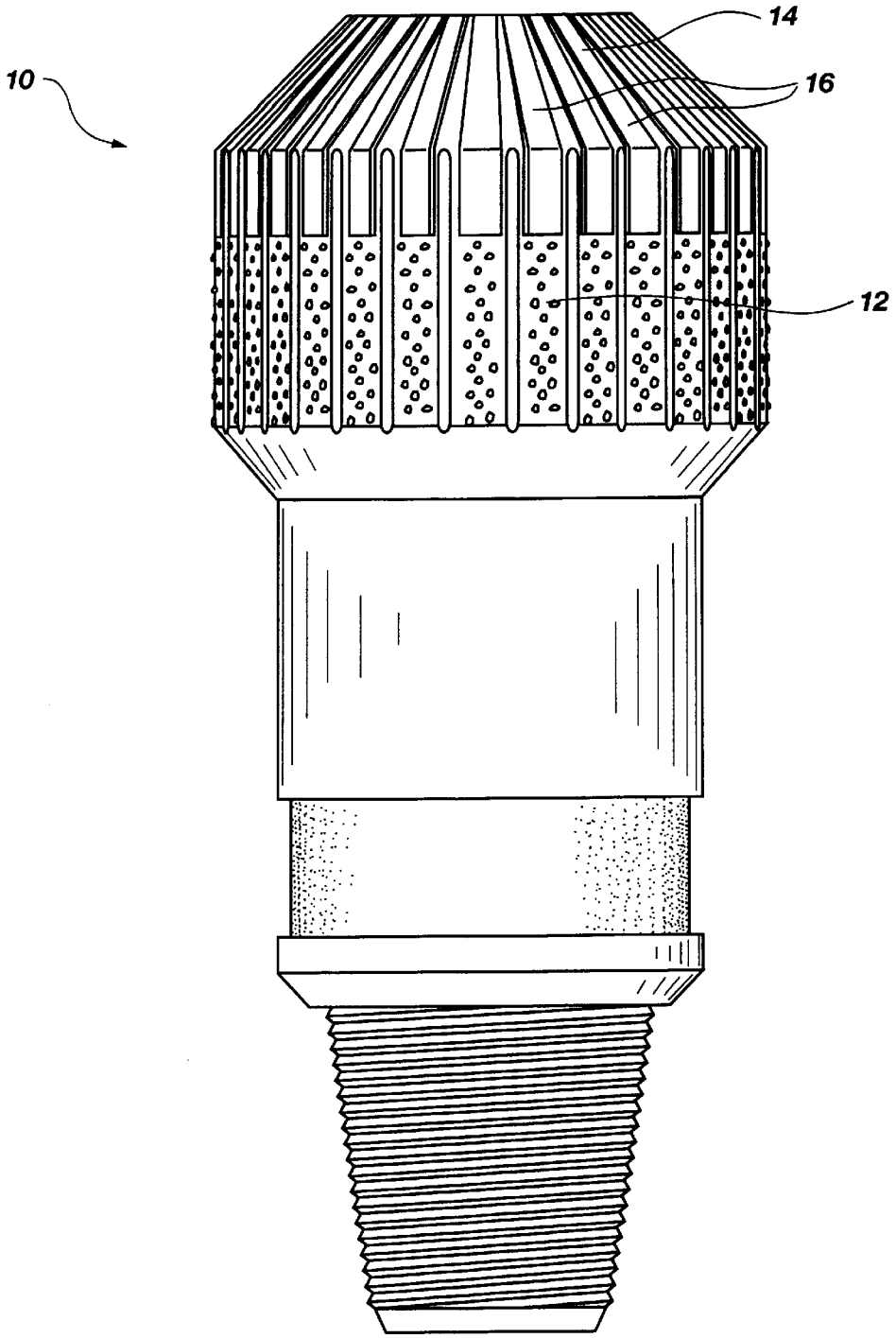
Fig. 1 (PRIOR ART)
FIG. 1 is an inverted side plan view of a conventional drill bit with impregnated segments disposed in a generally radial fashion over the crown of the drill bit.

With continued reference to FIG. 3, due to the insertion of segment-receiving portion 38 of support member 36 into recess 34 (see FIG. 2) of impregnated segment 32, support member 36 braces and somewhat resiliently supports impregnated segment 32 against both normal and torsional rotational stresses encountered during drilling. Thus, support member 36 may reduce the likelihood that impregnated segment 32 will fracture or otherwise be damaged during drilling. Accordingly, support member 36 facilitates a higher profile or exposure of cutting elements 30 relative to bit face 54 than conventional drill bits that carry impregnated segments (see FIG. 1). Thus, a greater volume and depth of space may exist between adjacent cutting elements 30 on drill bit 48 than between conventional impregnated segments that are carried upon a similarly configured drill bit. This increased volume and depth of space between adjacent cutting elements 30 improves the hydraulic performance of drill bit 48 relative to conventional drill bits which carry impregnated segments. Consequently, cutting elements 30 facilitate an increased rate of debris removal from the drilling surface. Similarly, more drilling fluid may be supplied to the impregnated segments, which facilitates a reduction in the amount of potentially damaging friction generated at crown 52, as well as increases the rate at which the impregnated segments are cooled, reducing the likelihood of damaging the segments and potentially decreasing their rate of wear due to heat-induced degradation of the segment continuous phase material.

Figure 4:
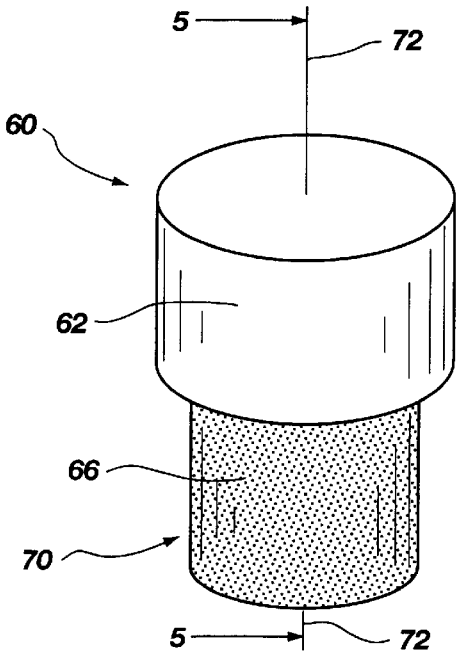
FIG. 4 is a frontal perspective view of another embodiment of the cutting element of the present invention, wherein the support member is an elongated member having an impregnated segment disposed on a portion thereof.
Figure 5:
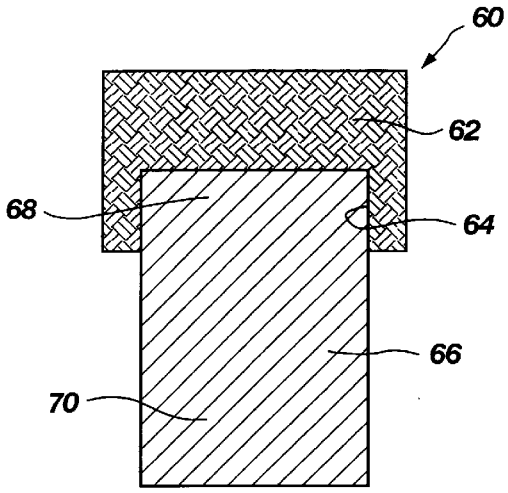
FIG. 5 is a cross-section taken along line 5—5 of FIG. 4.

FIGS. 4 and 5 illustrate another embodiment of the cutting element 60 of the present invention, which includes a post-like support member 66, which is also referred to as a member, with an impregnated segment 62 disposed on a portion thereof. Preferably, impregnated segment 62 is fabricated from a continuous phase material that is impregnated with an abrasive material, such as the continuous phase materials and abrasive materials described above in reference to the impregnated segment 32 of cutting element 30, shown in FIG. 2. The continuous phase material and abrasive material of impregnated segment 62 may also be aggregated by known processes, such as sintering, hot isostatic pressing, laser melting, or ion beam melting. Impregnated segment 62 has a circular cross section, taken transverse to a longitudinal axis 72 of cutting element 60, and includes a receptacle 64 formed in a bottom surface thereof.

Support member 66 may be an elongated structure which includes a segment-receiving portion 68 at one end thereof and a bit attachment portion 70 at the opposite end thereof. Segment-receiving portion 68 is preferably shaped complementarily to receptacle 64 of impregnated segment 62 so that it may receive and secure the impregnated segment or impregnated segment 62 may be formed over support member 66. Support member 66 may be fabricated from the same material and processes that may be employed to fabricate support member 36, which is shown in FIG. 2. Similarly, known techniques, such as those described above in reference to FIG. 2, may be employed to secure impregnated segment 62 to support member 66.

Figure 6:
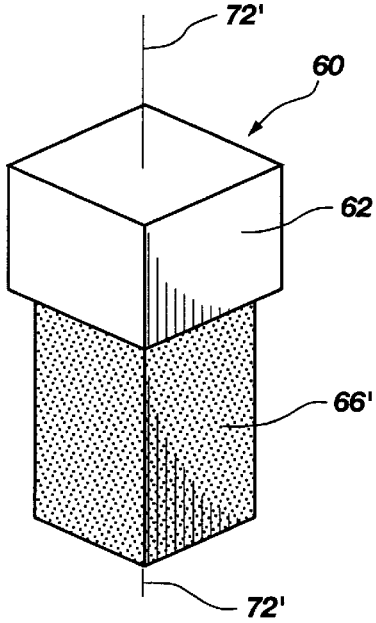
FIG. 6 is a perspective view of a variation of the cutting element of FIGS. 4 and 5, wherein the support member and impregnated segment each include a non-circular cross-section.

FIG. 6 illustrates a variation of the present embodiment of the cutting element 60', which includes a rectangular-shaped impregnated segment 62' attached to a portion of a support member 66' of rectangular cross section taken transverse to a longitudinal axis 72' of the cutting element. Similarly, the impregnated segments and support members of other variations of the present embodiment of the cutting element may have other, non-cylindrical shapes.

Figure 7:
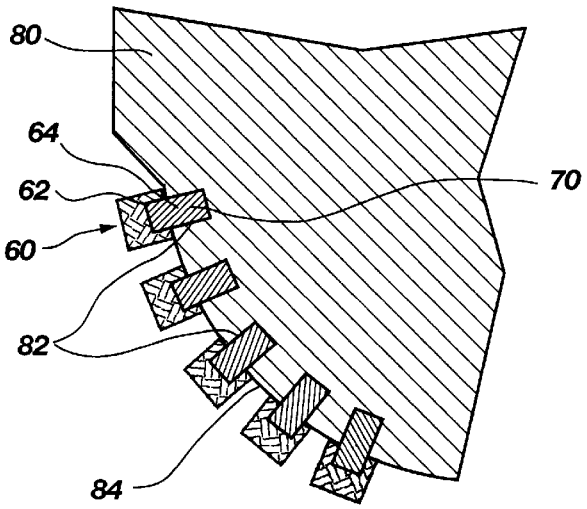
FIG. 7 is a partial vertical cross-sectional view of a bit body, which illustrates the member of FIGS. 4 and 5 disposed in a socket of the bit body with the entire impregnated segment being located externally relative to the bit face.

As shown in FIG. 7, bit attachment portion 70 of support member 66 may be disposed within a socket 82 formed in a face 84 of a bit body 80 by similar techniques to those described above in reference to FIG. 3 Preferably, socket 82 is shaped complementarily to bit attachment portion 70 in order to receive cutting element 60 and securely attach same to bit body 80. In FIG. 7, cutting elements 60 are arranged on bit face 84 such that impregnated segments 62 are located entirely external relative to the bit face, and the bottom surface of the impregnated segments may abut the bit face.

Figure 8:
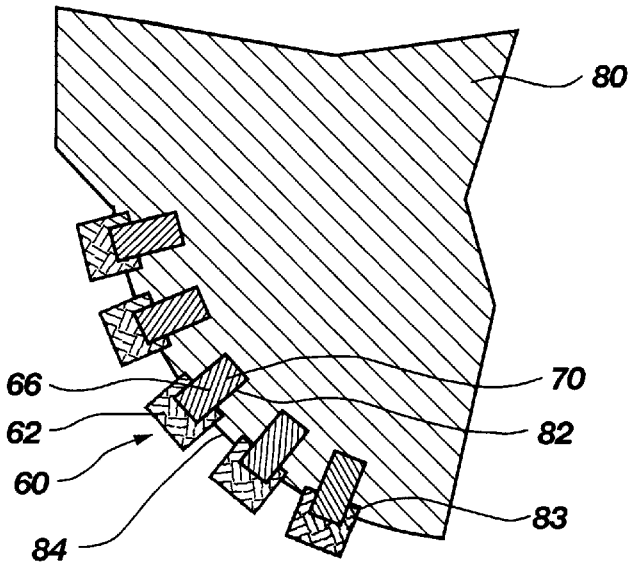
FIG. 8 is a partial vertical cross-sectional view of a bit body, which illustrates the support member of FIGS. 4 and 5 disposed in a socket of the bit body and a portion of the impregnated segment disposed in a countersink formed about the socket.

Alternatively, as shown in FIG. 8, each socket 82 may include a countersink 83 around the opening thereof, within which a lower portion of impregnated segment 62 may be disposed as a support member 66 is positioned within socket 82 and cutting element 60 is attached to bit body 80. When a portion of impregnated segments 62 is located below bit face 84, the interface between impregnated segment 62 and support member 66 is shielded from the drilling surface, debris and drilling fluid that may otherwise penetrate the interface and dislocate impregnated segment 62 from support member 66 by erosion or abrasion.

Figure 9:
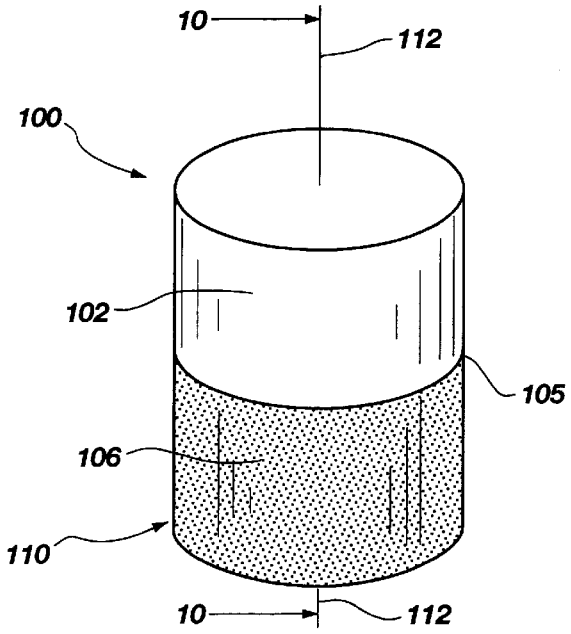
FIG. 9 is a frontal perspective view of another embodiment of the cutting element of the present invention, wherein the support member is an elongated member having an impregnated segment disposed on a portion thereof such that the periphery of the impregnated segment is substantially flush with the exposed periphery of the support member.
Figure 10:
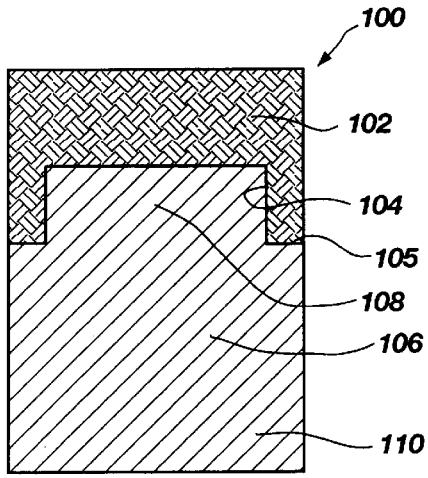
FIG. 10 is a cross-section taken along line 10—10 of FIG. 9.

Turning now to FIGS. 9 and 10, another embodiment of the inventive cutting element 100 is shown, which includes an impregnated segment 102 disposed on a portion of a support member 106. Impregnated segment 102 and support member 106 each have a circular cross section, taken transverse to a longitudinal axis 112 of cutting element 100. Impregnated segment 102 includes a recess 104, which is also referred to as a member-securing portion, formed in the bottom thereof, which is configured to interconnect with a complementarily shaped segment-receiving portion 108 of support member 106. Support member 106 also includes a bit attachment portion 110 opposite segment-receiving portion 108. Preferably, segment-receiving portion 108 has a smaller circumference than bit attachment portion 110 and, when viewed from the top thereof, is concentrically positioned upon bit attachment portion 110.

Support member 106 and impregnated segment 102 may be interconnected by known techniques such as by the use of adhesives, brazing, mechanical affixation, or by aggregating the continuous phase material and abrasive material impregnated segment 102 directly onto segment-receiving portion 108 of support member 106.

When impregnated segment 102 and support member 106 are interconnected, a peripheral interface 105 is defined between the impregnated segment and support member. Preferably, impregnated segment 102 and bit attachment portion 110 of support member 106 may each have substantially constant cross-sectional (taken transverse to longitudinal axis 112) peripheral circumferences along the heights thereof. The cross-sectional peripheral circumferences of impregnated segment 102 and bit attachment portion 110 are substantially the same. Thus, the edges of impregnated segment 102 and support member 106 at peripheral interface 105 abut each other in a substantially flush arrangement, imparting cutting element 100 with a substantially cylindrical appearance.

Preferably, impregnated segment 102 is fabricated from a continuous phase material that is impregnated with an abrasive material, such as the continuous phase materials and abrasive materials described above in reference to the impregnated segment 32 of cutting element 30, shown in FIG. 2. Similarly, the continuous phase material and abrasive material of impregnated segment 102 may be aggregated by known processes, such as sintering, hot isostatic pressing, laser melting, or ion beam melting. Similarly, support member 106 is fabricated from the same materials and by the same techniques that are described above in reference to support member 36, which is also shown in FIG. 2.

Figure 12:
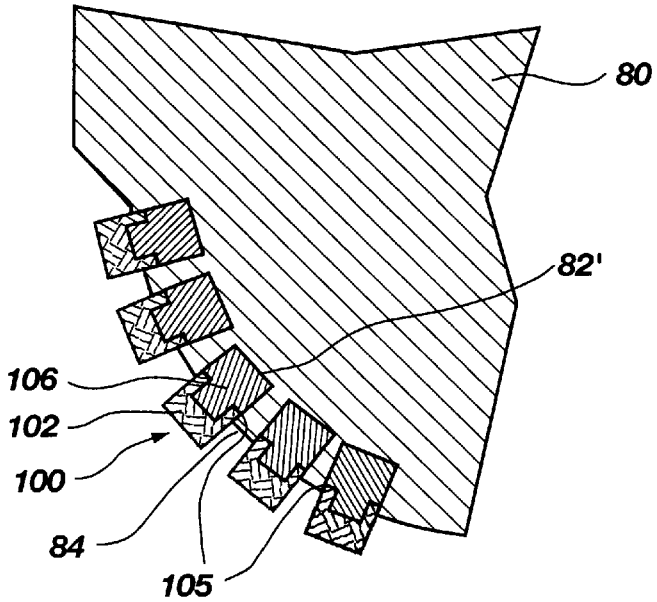
FIG. 12 is a partial vertical cross-sectional view of a bit body, which illustrates the support member of FIGS. 9 and 10 disposed in a socket of the bit body with a portion of the impregnated segment being located within the socket.
Figure 11:
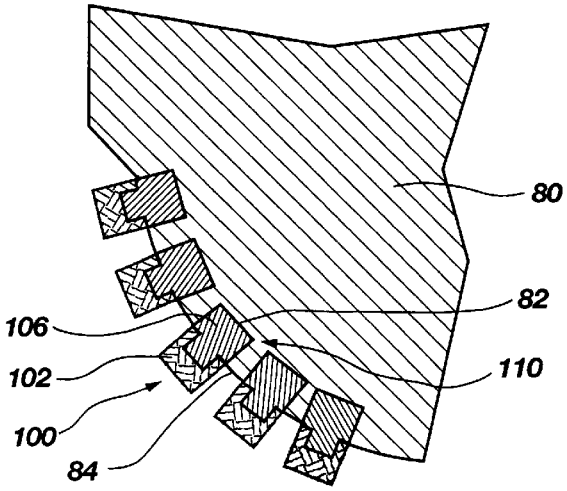
FIG. 11 is a partial vertical cross-sectional view of a bit body, which illustrates the support member of FIGS. 9 and 10 disposed in a socket of the bit body with the entire impregnated segment being located externally relative to the bit face.

Referring now to FIG. 11, bit attachment portion 110 of each support member 106 may be disposed within a socket 82 formed in a face 84 of a bit body 80. Preferably, sockets 82 are shaped complementarily to a corresponding bit attachment portion 110 so as to securely receive cutting element 100. Cutting element 100 may be secured to bit body 80 by techniques such as those described above in reference to FIG. 3. The depth of sockets 82 may be such that, when cutting elements 100 are attached to bit body 80, impregnated segments 102 are located entirely exterior of bit face 84. Alternatively, as shown in FIG. 12, deeper sockets 82' may receive a lower portion of impregnated segments 102, positioning the lower portion below bit face 84, and thereby shielding peripheral interface 105 from the drilling surface, debris and drilling fluid that may otherwise penetrate the interface and dislocate impregnated segment 102 from support member 106.

Figure 13:
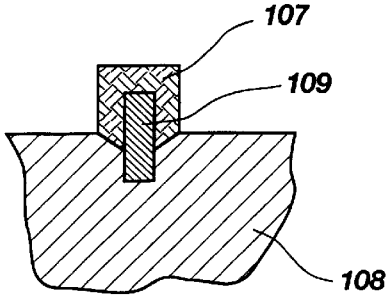
FIGS. 13–15 are cross-sectional views of alternative embodiments of the cutting element, wherein the cutting surface protrudes from the drill bit.
Figure 14:
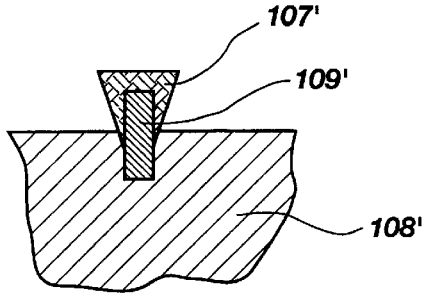
Figure 15:
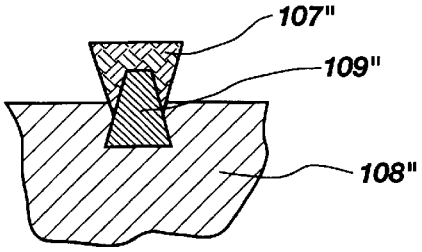

Other variations of cutting element 100 may have non-circular cross-sectional shapes, such as oval, elliptical, triangular, rectangular, other polygonal shapes, or other shapes. Exemplary variations of cutting element 100, which include impregnated segments that protrude from the drill bit, are illustrated in FIGS. 13–15, wherein segments 107, 107',107" are secured to drill bits 108, 108', 108" by support members 109, 109', 109", respectively.

Figure 16:
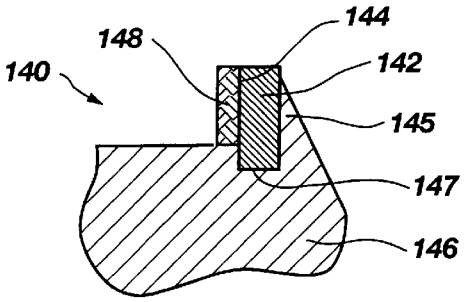
FIG. 16 is a cross-sectional view of another embodiment of the cutting element, wherein the impregnated segment faces the direction of rotation of the drill bit.

With reference to FIG. 16, another embodiment of a cutting element 140 of the present invention is shown. Cutting element 140 includes a support member 142 that is securable to a socket 147 defined in the face of a drill bit 146. Thus, support member 142 extends from drill bit 146. Support member 142 includes a leading face 144 which faces the direction of rotation of drill bit 146. Cutting element 140 also includes an impregnated segment 148 secured thereto and disposed on leading face 144 so as to facilitate contact of segment 148 with an interior surface of the bore hole during rotation of drill bit 146. Support member 142 may be supported from behind, relative to forces exerted thereagainst during drilling, by a buttress 145 of bit body material.

Figure 16A:
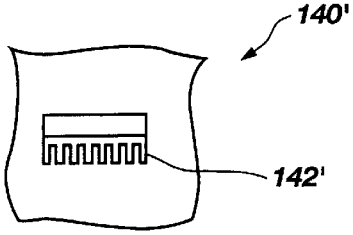
FIG. 16*a* is a top plan view of a variation of the embodiment of FIG. 16.

FIG. 16*a* illustrates a variation of the cutting element 140', wherein the support member 142' includes integral strengthening webs or struts, which configuration facilitates the fabrication of support member 142' with less material than that of support member 142 of the cutting element 140 of FIG. 16 and also provides additional surface area to bond support member 142 to the bit body.

Figure 17:
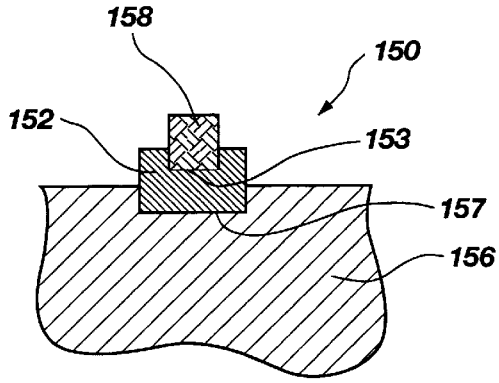
FIG. 17 is a cross-sectional view of another embodiment of the cutting element, wherein the support member includes a recess for receiving the impregnated segment or a portion thereof.

FIG. 17 illustrates yet another embodiment of a cutting element 150, which includes a support member 152 that is securable to a drill bit 156, such as in a socket 157 thereof, and includes a recess 153, which is also referred to as a member-securing portion. Recess 153 is configured to receive an impregnated segment 158, or an extension thereof, and secure the impregnated segment 158 thereto. Support member 152 may alternatively be secured to a matrix-type bit body during infiltration thereof.

Figure 25:
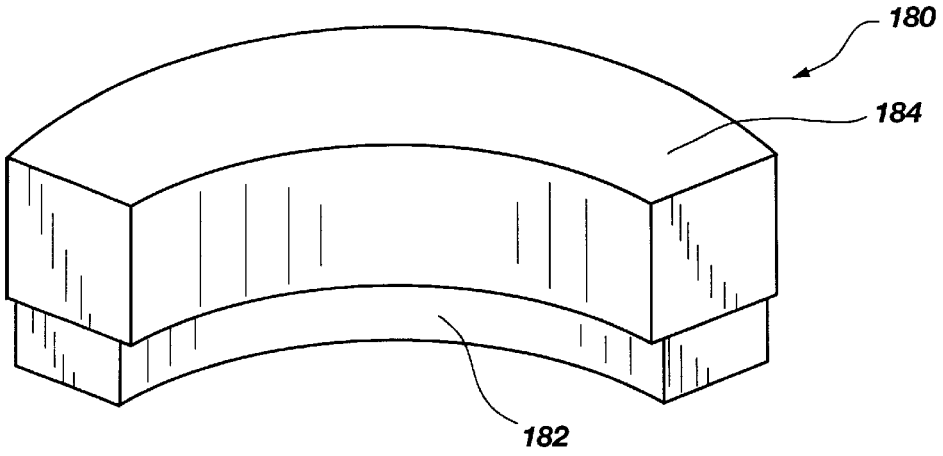
FIG. 25 is a frontal perspective view of an arcuate shaped segment and support member according to the present invention.

FIG. 25 depicts an arcuate shaped cutting element 180 according to the present invention. Cutting element 180 includes a support member 182 that is securable to a drill bit, such as by a socket thereof, and includes an impregnated segment 184 disposed thereon.

The support member of the present invention facilitates an increased exposure or profile of the impregnated segments relative to that of conventional impregnated segments. This increased exposure of the impregnated segments prevents the buildup of formation fines on the cutting surface of the impregnated segments, promotes self-sharpening of the impregnated segments, and reduces the surface area of the footprint of the drill bit, which facilitates the use of the drill bit hydraulics to clear formation fines and debris from the surfaces of the borehole and the bit face. Such use of the drill bit hydraulics to remove the formation fines also reduces "pack off," which occurs as fines gather on the impregnated segments, and which may reduce the depth of cut of the drill bit. The increased exposure of the impregnated segments also accommodates the cutting of hard "stringers," such as shale.

Figure 22:
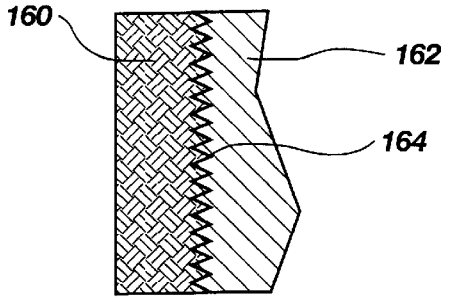
FIGS. 22–24 illustrate exemplary increased surface area interfaces between an impregnated segment and an associated support member.
Figure 23:
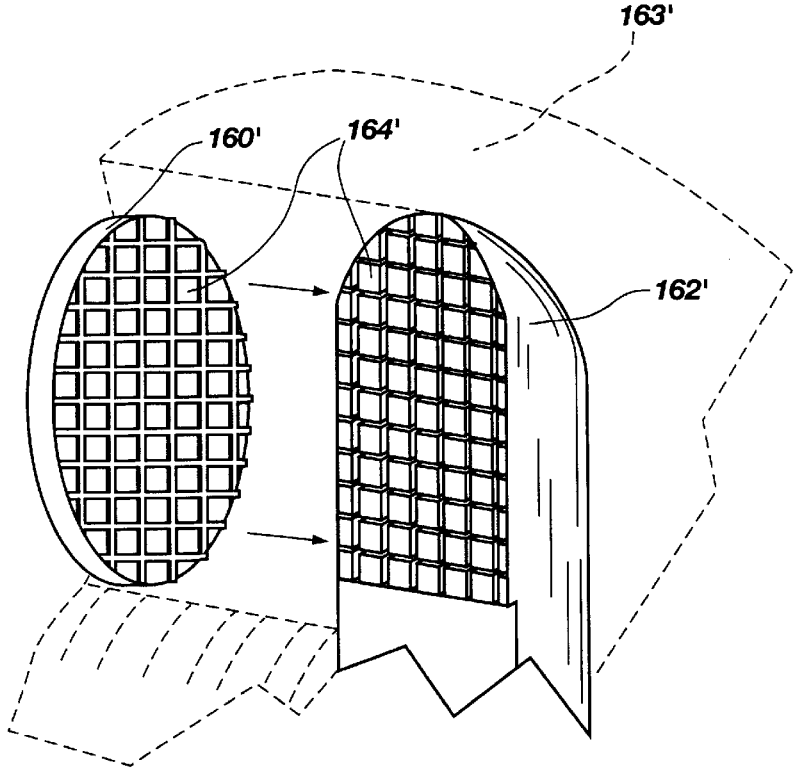
Figure 24:
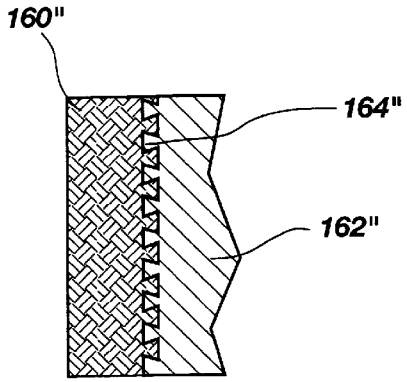

Referring to FIGS. 22–24, to enhance the strength with which an impregnated segment is bound to its corresponding securing member, the surface area of the interface 164, 164', 164' between an impregnated segment 160, 160', 160" and its corresponding support member 162, 162', 162", respectively, is preferably increased relative to that if a flat interface is employed. Accordingly, the segment-retaining portion of the support member 162, 162', 162" and the member-securing portion of the impregnated segment 160, 160', 160", respectively, may each comprise rough, preferably complementary, surfaces. Such high surface area interfaces prevent shearing or delamination of an impregnated segment off of a support member, which may be caused by bending stresses on the cutting element or to normal forces on the cutting element parallel to the member/segment interface. Accordingly, the mutually engaging surfaces of the impregnated segment-support member interface 164, 164', and 164" may include complementary thread cut (see FIG. 22), waffle (see FIG. 23), dove-tailed (see FIG. 24), dotted, or cross-hatched surfaces; apertures or blind holes and complementary protrusions; heavily sandblasted or otherwise roughened surfaces; or other configurations that increase the mutually-engaging surface areas of the two components. High surface area impregnated segment-support member interfaces are particularly useful in embodiments of the present invention that include relatively large, thin impregnated segments.

With continued reference to FIG. 23, a support member 162' according to the present invention may comprise a blade 163' of the drill bit to which impregnated segment 160' is secured.

Figure 18:
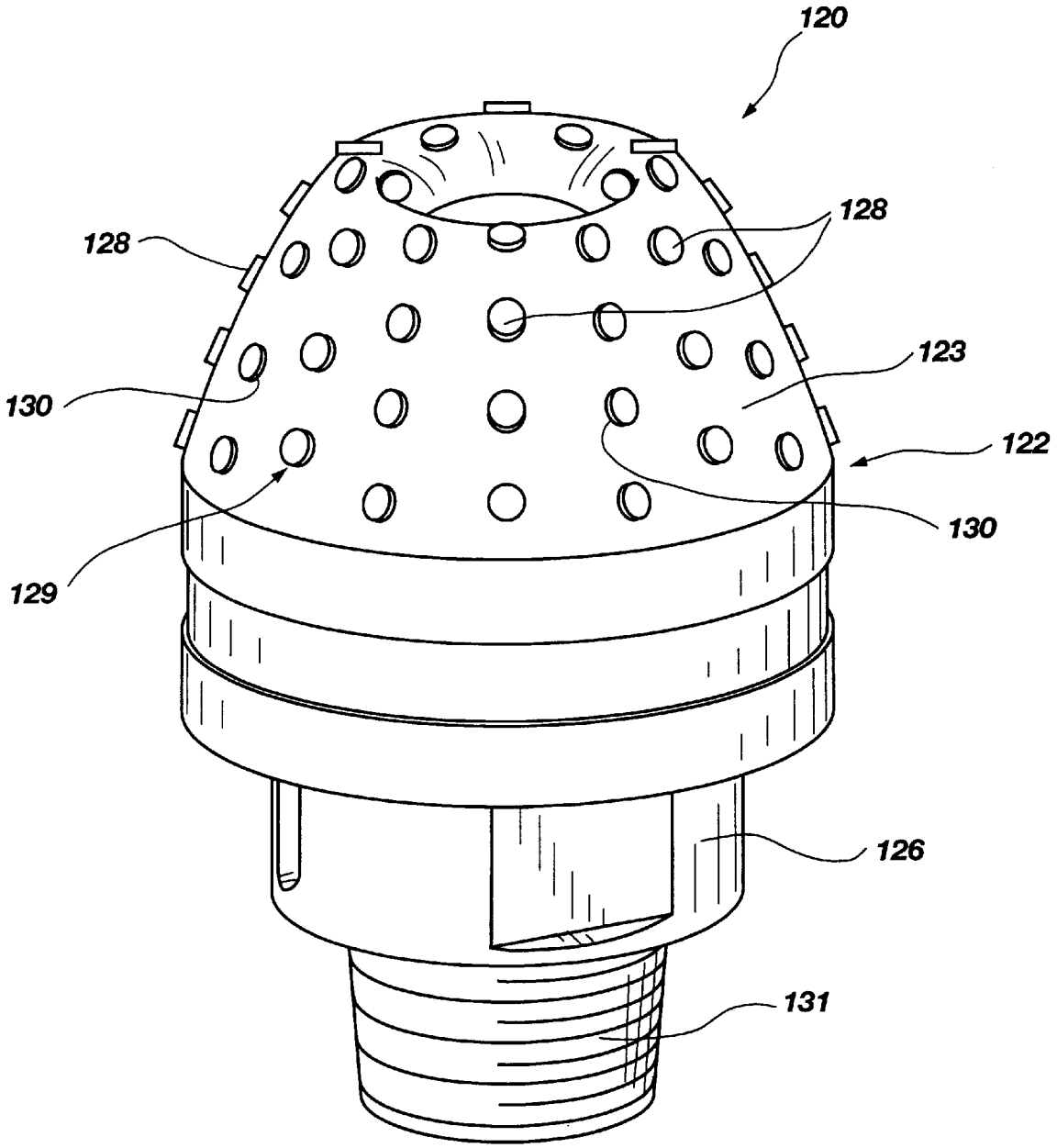
FIG. 18 is an inverted perspective view of a drill bit which carries the cutting elements of FIGS. 4 and 5 or of FIGS. 9 and 10.

FIG. 18 depicts a drill bit 120 which includes a bit body 122, a blank 126 that is partially disposed within the bit body, and a threaded shank 131 extending from the blank, which attaches the drill bit to a drill string, as known in the art. Bit body 122 carries a plurality of cutting elements 128 on the bit face 123 thereof. Cutting elements 128, which are preferably configured similarly to cutting elements 60, 100 described above in reference to FIGS. 4 and 5, and FIGS. 9 and 10, respectively, are preferably disposed in sockets 130 formed in bit face 123. Sockets 130 are preferably shaped complementarily to a bit attachment portion 70, 110 (see FIGS. 4 and 5, 9 and 10, respectively) of cutting elements 128.

Figure 19:
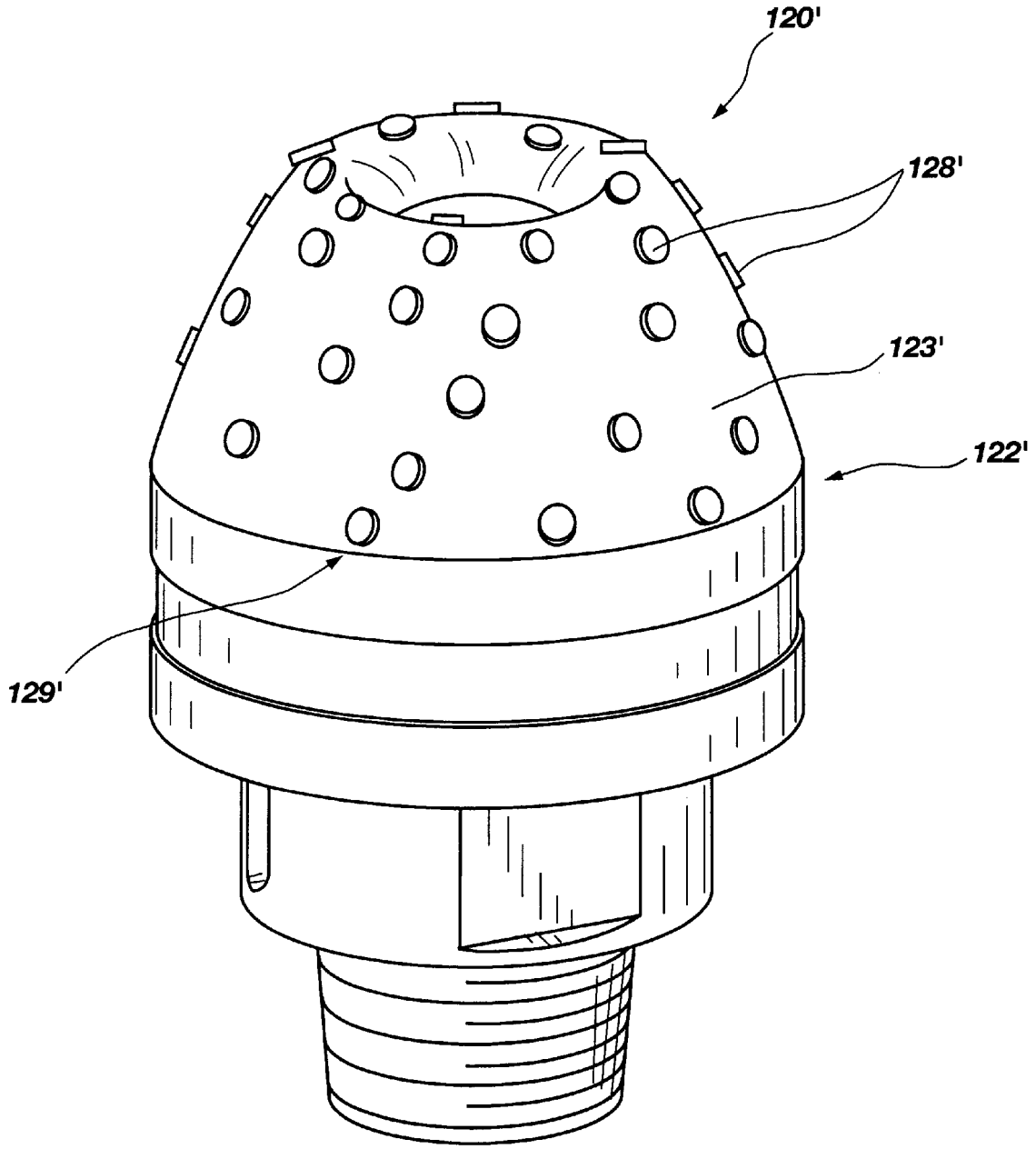
FIGS. 19–21 are inverted perspective views which each illustrate a variation of the drill bit of FIG. 18.
Figure 20:
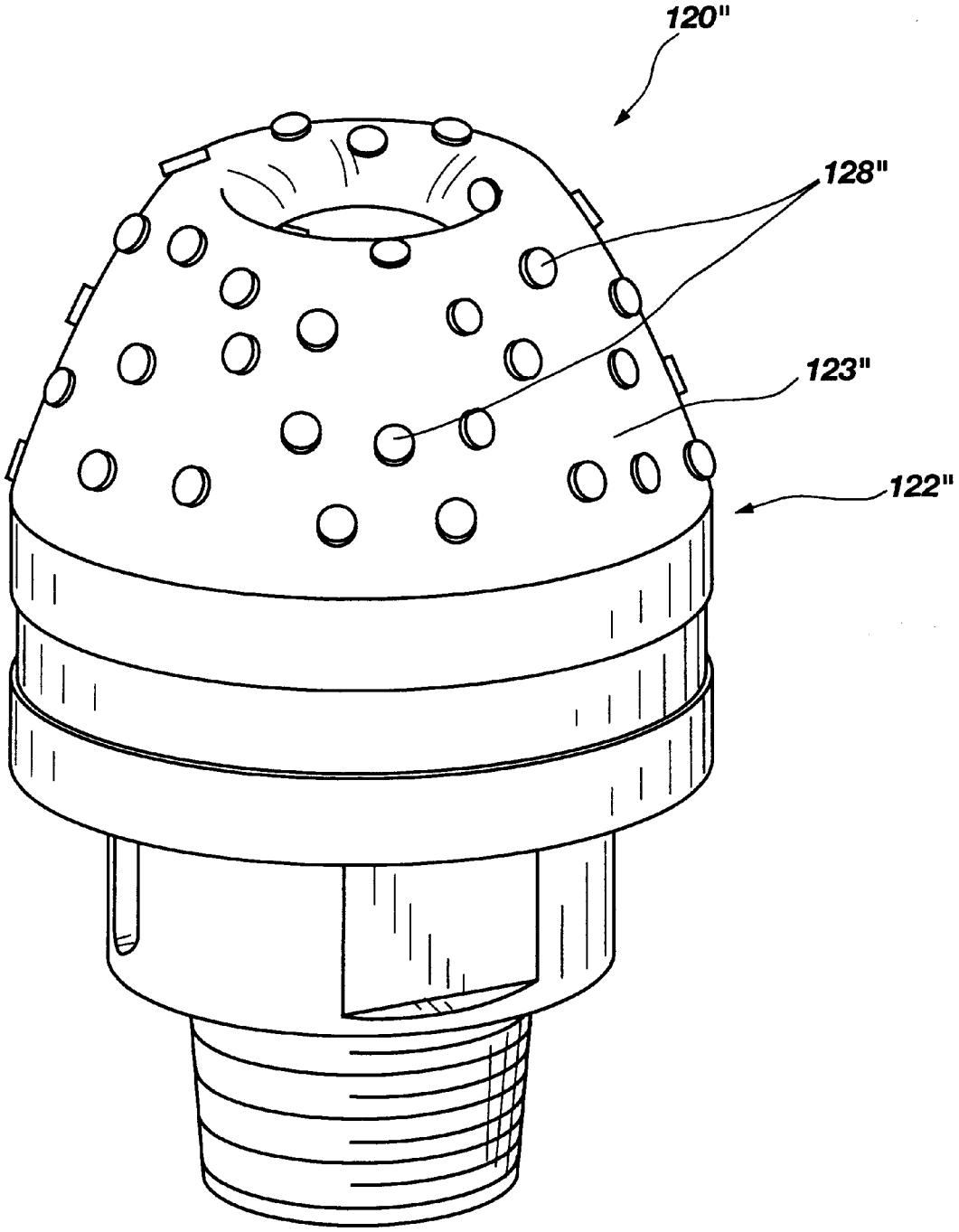
Figure 21:
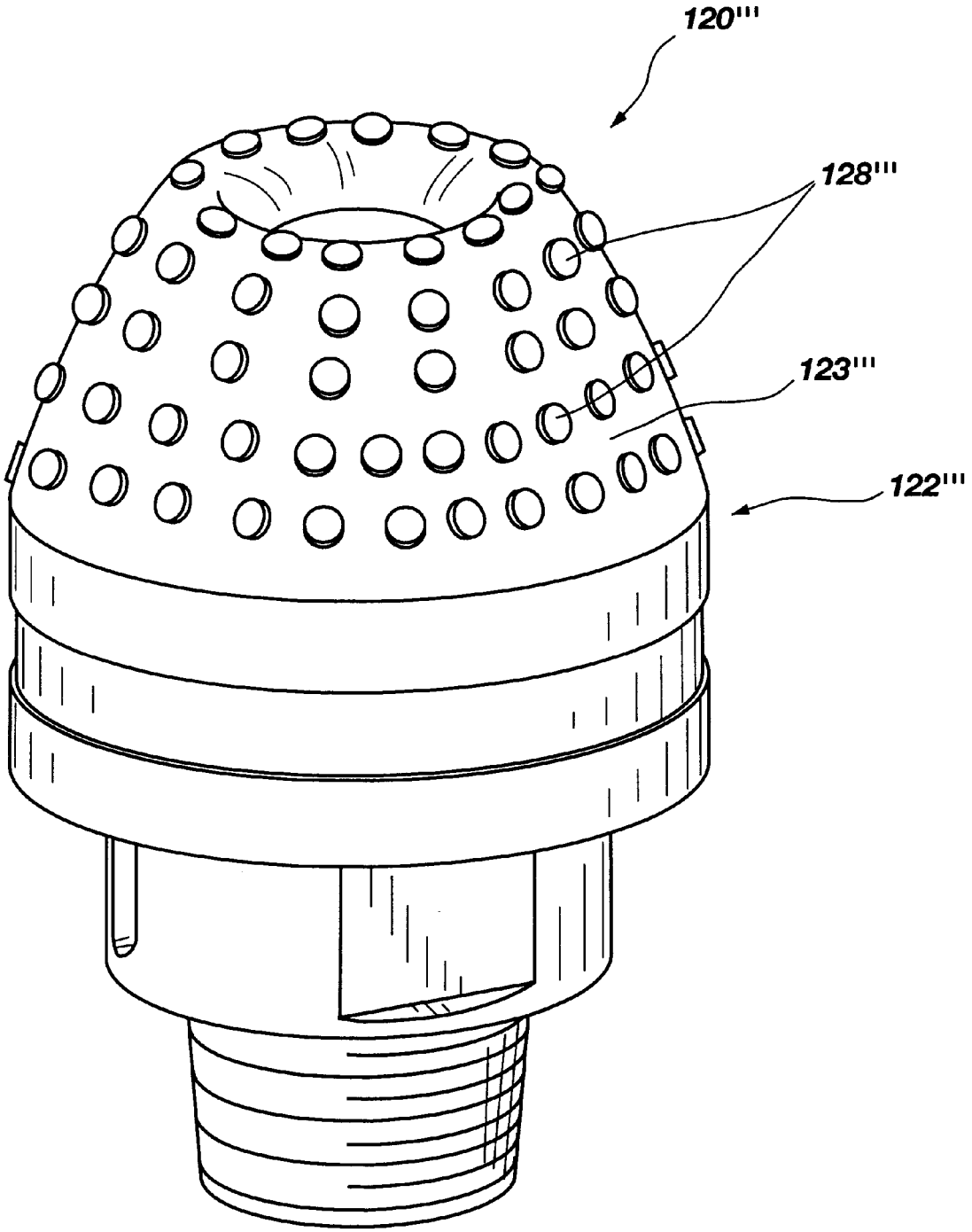
Figure 26:
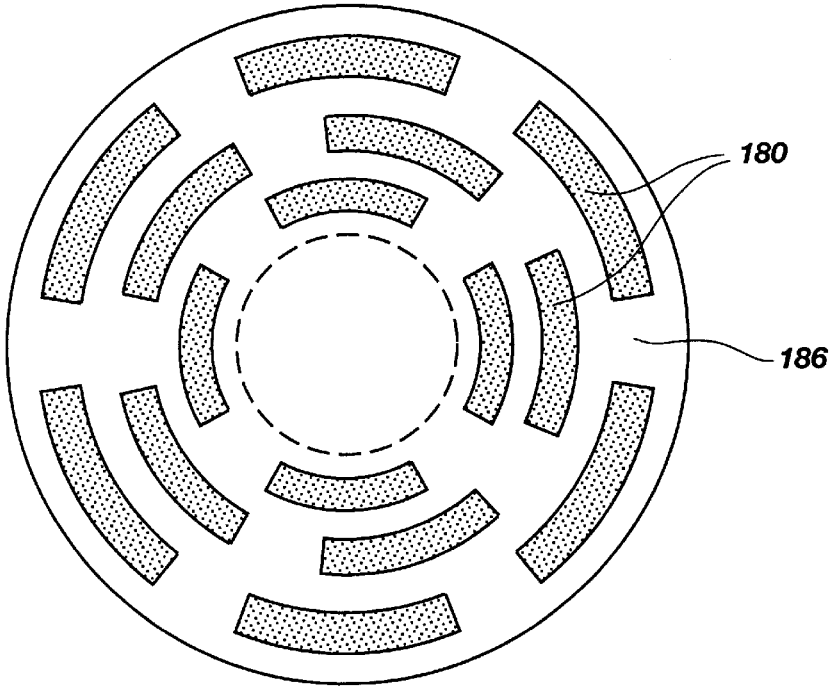
FIG. 26 is an bottom view of a drill bit including the arcuate shaped segments and support members of FIG. 25 disposed thereabout in a circumferential configuration.

Cutting elements 128 may be arranged in generally radial rows that extend over the crown of bit body 122. Alternatively, as shown in FIG. 19, cutting elements 128' may be disposed upon bit face 123' in rows 129' that extend somewhat spirally over the crown of bit body 122'. As another alternative, FIG. 20 illustrates a drill bit 120" that includes cutting elements 128" disposed over bit face 123" in a non-grouped arrangement. As yet another alternative, FIG. 21 illustrates a drill bit 120'" that includes cutting elements 128'" disposed over bit face 123'" in a concentric arrangement. FIG. 26 illustrates a drill bit 186 that includes arcuate cutting elements 180 (see FIG. 25) in a somewhat circumferential arrangement thereon.

Preferably, adjacent cutting elements 128 are arranged on the bit face. Such that, during drilling, the cutting elements cut the formation surface at the end of the borehole evenly, and at a substantially constant rate.

Referring again to FIG. 18, the support, member 66, 106 (see FIGS. 4 and 5, 9 and 10, respectively) of each cutting element 128 is secured within its corresponding socket 130 by known techniques, such as by the use of adhesives, brazing, or mechanical affixation. Alternatively, when support members 66, 106 are porous (e.g., comprised of sintered steel), they may be secured to bit body 122 during infiltration of a matrix material of bit body 122 as described above in reference to FIG. 3.

Due to the use of support members 66, 106 in conjunction with impregnated segments 62, 102, for the same reasons that were discussed above in reference to FIG. 3, cutting elements 128 better withstand the stresses of drilling and, therefore, may be positioned upon drill bit 120 in a manner which improves the hydraulic performance thereof relative to that of conventional impregnated segment-bearing drill bits. Accordingly, an increased amount of drilling fluid may be supplied to bit face 123, which facilitates an increased rate of debris removal from the drilling surface of the bore hole, a reduction in the amount of potentially damaging friction that occurs during cutting, and an increase in the rate at which cutting elements 128 are cooled.

Although the foregoing description contains many specifics, these should not be construed as limiting the scope of the present invention, but merely as providing illustrations of some of the presently preferred embodiments. Similarly, other embodiments of the invention may be devised which do not depart from the spirit or scope of the present invention. The scope of this invention is, therefore, indicated and limited only by the appended claims and their legal equivalents, rather than by the foregoing description. All additions, deletions and modifications to the invention as disclosed herein which fall within the meaning and scope of the claims are to be embraced thereby.

What is claimed is:

1. A cutting element for use on an earth boring drill bit for drilling subterranean formations, comprising:

a member including a segment-retaining portion and a drill bit attachment portion attachable to a drill bit; and a C-shaped segment comprising a continuous phase impregnated with a particulate abrasive material, and secured to said segment-retaining portion, at least a portion of at least one of said member and said segment receiving at least a portion of the other of said member and said segment.

2. The cutting element of claim 1, wherein said member comprises a tough and ductile material.

3. The cutting element of claim 2, wherein said tough and ductile material comprises iron, an iron-based alloy, nickel, a nickel-based alloy, copper, a copper-based alloy, titanium, a titanium-based alloy, zirconium, a zirconium-based alloy, silver, or a silver-based alloy.

4. The cutting element of claim 1, wherein said continuous phase comprises a metal carbide, a refractory metal alloy, a ceramic, copper, a copper-based alloy, nickel, a nickel-based alloy, cobalt, a cobalt-based alloy, iron, an iron-based alloy, silver, or a silver-based alloy.

5. The cutting element of claim 1, wherein said particulate abrasive material comprises at least one of natural diamond, synthetic diamond, or cubic boron nitride.

6. The cutting element of claim 1, wherein said segment further comprises a secondary particulate abrasive.

7. The cutting element of claim 1, wherein said segment comprises a member-securing portion including a shape complementary to a shape of said segment-receiving portion.

8. The cutting element of claim 1, wherein said segment faces in a direction of drilling of the earth boring drill bit.

9. A rotary-type earth boring drill bit for drilling subterranean formations, comprising:

a bit body; and at least one cutting element comprising:

a member including a segment-retaining portion and a drill bit attachment portion at least partially disposed within said bit body; and a C-shaped segment comprising a continuous phase impregnated with particulate abrasive material, said segment including a member-securing portion to which said segment-retaining portion of said member is secured, at least a portion of at least one of said member and said segment receiving at least a portion of the other of said member and said segment.

10. The drill bit of claim 9, wherein said bit body comprises at least one socket.

11. The drill bit of claim 10, wherein said at least one socket comprises a shape complementary to said drill bit attachment portion.

12. The drill bit of claim 9, wherein said member comprises iron, an iron-based alloy, nickel, a nickel-based alloy, copper, a copper-based alloy, titanium, a titanium-based alloy, zirconium, a zirconium-based alloy, silver, or a silver-based alloy.

13. The drill bit of claim 12, wherein said bit body includes a particulate-based matrix infiltrated with a binder.

14. The drill bit of claim 13, wherein at least a portion of said binder secures said member to said bit body.

15. The drill bit of claim 9, wherein said member-securing portion comprises a shape complimentary to said segment-retaining portion.

16. The drill bit of claim 9, comprising a plurality of said cutting elements.

17. The drill bit of claim 16, comprising at least one row comprising cutting elements of said plurality.

18. The drill bit of claim 9, wherein said particulate abrasive material comprises at least one of natural diamond, synthetic diamond, or boron nitride.

19. A cutting element for use on an earth boring drill bit for drilling subterranean formations, comprising:

a C-shaped segment comprising a continuous phase impregnated with a particulate abrasive material, said segment including at least one portion that receives or is received by another member of the cutting element.

20. The cutting element of claim 19, wherein said continuous phase comprises at least one of a metal carbide, a refractory metal alloy, a ceramic, copper, a copper-based alloy, nickel, a nickel-based alloy, cobalt, a cobalt-based alloy, iron, an iron-based alloy, silver, and a silver-based alloy.

21. The cutting element of claim 19, wherein said particulate abrasive material comprises at least one of natural diamond, synthetic diamond, and cubic boron nitride.

22. The cutting element of claim 19, wherein said segment is configured to protrude from the earth boring drill bit.

23. The cutting element of claim 22, wherein said continuous phase is configured to protrude from a crown profile of the earth boring drill bit.

24. A rotary-type earth boring drill bit for drilling subterranean formations, comprising:

a bit body; and at least one cutting element secured to said bit body so as to protrude therefrom, said at least one cutting element including a C-shaped segment with a continuous phase impregnated with a particulate abrasive material, said segment including at least one portino that receives or is received by another member of said at least one cutting element.

25. The rotary-type earth boring drill bit of claim 24, wherein said at least one cutting element protrudes from a crown profile of said bit body.

26. The rotary-type earth boring drill bit of claim 24, wherein said continuous phase comprises at least one of a metal carbide, a refractory metal alloy, a ceramic, copper, a copper-based alloy, nickel, a nickel-based alloy, cobalt, a cobalt-based alloy, iron, an iron-based alloy, silver, and a silver-based alloy.

27. The rotary-type earth boring drill bit of claim 24, wherein said particulate abrasive material comprises at least one of natural diamond, synthetic diamond, and cubic boron nitride.

28. A cutting element for use on an earth boring drill bit for drilling subterranean formations, comprising:

a member including a segment-retaining portion and a drill bit attachment portion attachable to a drill bit; and a segment comprising a continuous phase impregnated with a particulate abrasive material, and secured to said segment-retaining portion, wherein said segment is C-shaped.

29. The cutting element of claim 28, wherein said member comprises a tough and ductile material.

30. The cutting element of claim 29, wherein said tough and ductile material comprises iron, an iron-based alloy, nickel, a nickel-based alloy, copper, a copper-based alloy, titanium, a titanium-based alloy, zirconium, a zirconium-based alloy, silver, or a silver-based alloy.

31. The cutting clement of claim 28, wherein said continuous phase comprises a metal carbide, a refractory metal alloy, a ceramic, copper, a copper-based alloy, nickel, a nickel-based alloy, cobalt, a cobalt-based alloy, iron, an iron-based alloy, silver, or a silver-based alloy.

32. The cutting element of claim 28, wherein said particulate abrasive material comprises at least one of natural diamond, synthetic diamond, or cubic boron nitride.

33. The cutting element of claim 28, wherein said segment further comprises a secondary particulate abrasive.

34. The cutting element of claim 28, wherein said segment comprises a member-securing portion including a shape complementary to a shape of said segment-receiving portion.

* * * * *